US007398754B2

(12) United States Patent
Tanihata et al.

(10) Patent No.: US 7,398,754 B2
(45) Date of Patent: Jul. 15, 2008

(54) PISTON FOR INTERNAL COMBUSTION ENGINE

(75) Inventors: Akito Tanihata, Wako (JP); Naoko Sato, Wako (JP); Hisayasu Kojima, Wako (JP); Kouji Katsumata, Wako (JP); Takashi Shiraishi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 43 days.

(21) Appl. No.: 11/524,271

(22) Filed: Sep. 21, 2006

(65) Prior Publication Data

US 2007/0062479 A1 Mar. 22, 2007

(30) Foreign Application Priority Data

Sep. 21, 2005 (JP) ..... 2005-273800

(51) Int. Cl.
*F02F 3/00* (2006.01)

(52) U.S. Cl. ..... 123/193.6; 29/888.047

(58) Field of Classification Search ..... 29/888.04, 29/888.047; 123/193.6
See application file for complete search history.

(56) References Cited

U.S. PATENT DOCUMENTS 5,253,625 A * 10/1993 Donahue et al. ..... 123/193.4
5,996,471 A * 12/1999 Aikawa et al. ..... 92/222
6,070,323 A 6/2000 Koike et al.
2004/0057865 A1* 3/2004 Ikuno et al. ..... 420/535
2006/0266443 A1* 11/2006 Oka et al. ..... 148/438

FOREIGN PATENT DOCUMENTS

JP 10-219378 A 8/1998
JP 3043375 B2 3/2000
JP 2005-120891 A 5/2005

* cited by examiner

*Primary Examiner*—M. McMahon
(74) *Attorney, Agent, or Firm*—Arent Fox LLP

(57) ABSTRACT

A piston for internal combustion engine has both fatigue strength and wear resistance without increased production cost. At least one of a combustion chamber surface, a skirt rib, a pin boss rib which connects a pin boss and a crown, a lower portion of the pin boss casting surface, and a surface layer including the casting surface is a first eutectic structure in which primary crystal Si does not crystallize. A top ring groove and a pin holing of a piston pin are finished surfaces obtained by eliminating the surface layer by means of machining. The layer including the finished surface is a second eutectic structure in which the primary crystal Si crystallizes.

4 Claims, 4 Drawing Sheets

PISTON FOR INTERNAL COMBUSTION ENGINE

BACKGROUND OF THE INVENTION

1. Field of the Invention

The present invention relates to a piston for internal combustion engine having both fatigue strength and wear resistance.

2. Related Art

Conventionally, pistons for internal combustion engines (hereinafter, simply called as "piston") are manufactured by a gravity casting method using an Al-Si metal alloy such as Japanese Industrial Standard JIS AC8A. In recent years, however, as engine output has been increased, fatigue strength and wear resistance are being improved, so that the content of additive elements such as Si, Cu, Ni and Mn tends to be increased. When 11 or more wt % of Si among such additive elements is added, it generates hypereutectic structures, and hard and granular primary crystal Si crystallizes so that the wear resistance is improved. For this reason, Si is widely adopted for Al alloys of pistons for high-power engines.

In these Al-rich Si alloys, however, coarse primary crystal Si crystallizes in casting, and the primary crystal Si causes fatigue breakdown so that the fatigue strength is deteriorated. Local uniformity of the structure occurs and hardness variation becomes large, so that the wear resistance in a softened portion is deteriorated and workability in a hardened portion is deteriorated.

In order to overcome the above disadvantages, for example in Japanese Patent No. 3043375 (in the section "Function"), when pistons are manufactured by the gravity casting method using an Al—Si alloy, P is added so that coarsening of primary crystal Si is suppressed. Furthermore, in Japanese Patent Application Laid-Open No. 10-219378 (in section 0008), after an Al alloy containing Si is dissolved and is rapidly solidified, a fine powder in which primary crystal Si is crushed is manufactured, and the powder is heat-extruded and molded so that a piston is manufactured.

In Japanese Patent Application Laid-Open No 2005-120891 (in the Abstract), after a piston is manufactured from an Al—Si alloy, in order to strengthen a necessary portion, a copper material is cast into that portion of the alloy by an electron beam.

The function of a piston is to form a firing pressure container, to contain the firing pressure, and to transmit the firing pressure. The pistons for internal combustion engines require different properties, depending on the portion, in order to fulfill this function. The typical required properties of the pistons include the following two properties:

(1) Wear resistance in sliding portions such as the top ring groove and the pin holing of a piston pin; and (2) High fatigue strength in portions such as the surface of the piston combustion chamber, the pin boss rib, the outer peripheral surface of the lower portion of the pin boss and the skirt rib, on which a large stress load is applied by firing pressure and inertial force.

Unfortunately, the grain size of the primary crystal Si yields conflicting properties. That is to say, when the grain size of the primary crystal Si is large, the wear resistance is satisfactory, but the fatigue strength is deteriorated, and when the grain size of the primary crystal Si is small (or the primary Si is not present), the fatigue strength is high, but the wear resistance is deteriorated. In techniques for making the primary crystal Si fine as described in Japanese Patent No. 3043375 and Japanese Patent Application Laid-Open No. 10-219378, an entire portion of the piston has an approximately uniform structure, and thus the structures are not optimized for each portion. For this reason, in the pistons which require different properties depending on portions, one of the wear resistance and the fatigue strength is insufficient, and thus these techniques cannot sufficiently cope with high-power engines.

In the technique disclosed in the Japanese Patent No. 3043375 which makes the primary crystal Si fine by adding P, since the gravity casting method is used, the cooling rate at the time of the casting is relatively slow, and the mold temperature cannot be reduced in view of the molten metal. As a result, the primary crystal Si becomes coarse. For this reason, although the wear resistance of the top ring groove and the like can be secured by the primary crystal Si, the primary crystal Si crystallizes on the surface of the piston combustion chamber, the pin boss rib, the outer peripheral surface of a lower portion of the pin boss, and the casting surface of the skirt rib, and thus the fatigue strength of these portions is deteriorated.

In the technique disclosed in Japanese Patent Application Laid-Open No. 10-219378 which uses heat-extrusion and molding of powder so as to manufacture a piston, the grain size of the primary crystal Si can be reduced to an extent such that fatigue breakdown does not occur. Since, however, the wear resistance of the top ring groove and the like is insufficient, secondary particles such as SiC should be added to the powder. For this reason, the production costs of pistons are high.

In the technique disclosed in Japanese Patent Application Laid-Open No 2005-120891 which casts a copper material in parts so as to strengthen a piston, a measure for suppressing internal defects due to a gas generated at the time of melting the copper material, and a step of setting a distortion of the piston due to heating straightening is required. Since the number of steps including the melting step increases, the production cost becomes relatively high.

SUMMARY OF THE INVENTION

It is an object of the present invention to provide a piston for internal combustion engine having both fatigue strength and wear resistance without increasing the production cost, and to provide a manufacturing method therefor.

The present invention provides a piston for internal combustion engine, which is obtained by die-casting a hypereutectic Al-Si alloy containing 11 to 18 wt % of Si, includes: a piston crown whose top face is a combustion chamber surface; a piston skirt portion; a pin holing of piston pin; a pin boss which the pin holing of a piston pin pierces; and a top ring groove formed on an outer peripheral surface. The piston for internal combustion engine has at least one of the combustion chamber surface, a pin boss rib which connects the pin boss and the crown, an outer peripheral surface of a lower portion of the pin boss, and a skirt rib which connects the pin boss and the piston skirt portion as a casting surface. Furthermore, a surface layer including the casting surface is composed of a first eutectic structure in which primary crystal Si does not crystallize, at least one of the top ring groove and the pin holing of a piston pin is a finished surface which is obtained by eliminating the surface layer, and a layer including the finished surface is composed of a second eutectic structure in which the primary crystal Si crystallizes.

According to the present invention, a portion of the piston which requires high fatigue strength is the casting surface, and the surface layer including the casting surface is the first eutectic structure. For this reason, the development of fatigue breakdown due to the primary crystal Si at the time of loading a stress can be suppressed. A portion of the piston which requires high wear resistance is a finished surface whose surface layer is removed, and the primary crystal Si including the finished surface is a second eutectic structure at which the primary crystal Si crystallizes. For this reason, wear can be suppressed by the effect of particles of the primary crystal Si having high hardness.

The supereutectic Al—Si alloy has a composition which contains 11 to 18 wt % of Si. and the remainder is composed of Al and unavoidable impurities. It is, however, preferable that an alloy element be further added, and thus the Al—Si alloy further contains at least one of 1.0 to 6.0 wt % of Cu, 1.0 to 6.0 wt % of Ni, 0.5 to 2.0 wt % of Mg, 0.1 to 2.0 wt % of Fe, and 30 to 200 ppm of P. and the remainder is composed of Al and unavoidable impurities. The function of the alloy elements is explained below.

Si: 11 to 18 wt %

It is widely known that Si is an element necessary for improving wear resistance, and in particular, the granular primary crystal Si is effective for the wear resistance. Since the Al-Si eutectic point is present in Si in the vicinity of 11 wt %, the supereutectic Al-Si alloy should contain 11 or more wt % of Si. When, however, the content of Si exceeds 18 wt %, the melting point of the alloy becomes excessively high, so that the amount of gas in the molten metal increases or the life of the mold is shortened. The content of Si is, therefore, 11 to 18 wt %.

Cu: 1.0 to 6.0 wt %

Cu precipitates as $Al_2Cu$ in an Al base layer and contributes to the improvement of the fatigue strength around 150 to 250° C. When the content of Cu is less than 1.0 wt %, its effect is insufficient, and when the content exceeds 6.0 wt %, the content exceeds the solid solubility limit of Cu in Al, and thus $Al_2Cu$ easily becomes coarse even in the die casing. As a result, the coarse $Al_2Cu$ causes the fatigue breakdown on the casting surface, and thus, the fatigue strength is deteriorated. Therefore, the content of Cu is preferably 1.0 to 6.0 wt %.

Ni: 1.0 to 6.0 wt %

Ni forms an Al-Ni crystallized product in the Al base phase, and contributes to the improvement of the fatigue strength at around 200 to 350° C. When the content of Ni is less than 1.0 wt %, the effect is insufficient, and when the content exceeds 6.0 wt %, Ni in Al exceeds the eutectic point, and thus the Al—Ni crystallized product easily becomes coarse even in die casting. As a result, the coarse Al—Ni crystallized product causes the fatigue breakdown on the casing surface, and the fatigue strength is deteriorated. It is therefore desirable that the content of Ni be 1.0 to 6.0 wt %.

Mg: 0.5 to 2.0 wt %

When Mg and Si coexist, $Mg_2Si$ is precipitated so that the strength is improved. When the content of Mg is less than 0.5 wt %, the improvement in the strength is insufficient, and when the content exceeds 2.0 wt %, cracking easily occurs at the time of die casting, and thus defective casting easily occurs. It is therefore desirable that the content of Mg be 0.5 to 2.0 wt %.

Fe: 0.1 to 2.0 wt %

Fe generates various intermetallic compounds and improves the fatigue strength near 200 to 350° C. similarly to Ni. When the content of Fe is less than 0.1 wt %, the improvement in the strength is insufficient, and when the content exceeds 2.0 wt %, Fe in Al exceeds the eutectic point, so that an Al—Fe crystallized product easily becomes coarse even in the die casting. As a result, the coarse Al—Fe crystallized product causes the fatigue breakdown on the casting surface, and the fatigue strength is deteriorated. It is therefore desirable that the content of Fe be 0.1 to 2.0 wt %.

P: 30 to 200 ppm

P becomes the nucleus of the primary crystal Si effective for the improvement of the wear resistance, and contributes to uniform and fine dispersion of the primary crystal Si. When the content of P is less than 30 ppm, the effect is insufficient, and when the content exceeds 200 ppm, molten metal fluidity is deteriorated. As a result, defective casting easily occurs. It is therefore desirable that the content of P be 30 to 200 ppm.

In the present invention, it is preferable that the piston contain at least one of Mn, Cr, Ti, V and Zr in a total content of 0.01 to 0.3 wt %. These elements make an α phase of Al fine and improves the fatigue strength. When the content of these elements is less than 0.01 wt %, their effect is insufficient, and even when the content exceeds 0.3 wt %, the effect cannot be improved. It is therefore desirable that the total content thereof be 0.01 to 0.3 wt %.

The above piston for internal combustion engine can be obtained by controlling the cooling rate at the time of the casting. That is to say, when the cooling rate of the mold at the time of the casting is high, the primary crystal Si hardly crystallizes on the surface layer of the molten metal contacting with the mold, and the primary crystal Si segregates on the inner side with respect to the surface layer. When the Al—Si alloy is cast into the piston by the die casting method, the molten metal is rapidly cooled by the mold, so that a piston in which the primary crystal Si does not crystallize on the surface layer can be obtained. When a predetermined portion is finished and the primary crystal Si is exposed, the wear resistance can be provided.

A manufacturing method for piston of internal combustion engine of the present invention reliably yields the above characteristics. The manufacturing method for a die-cast hypereutectic Al—Si alloy containing 11 to 18 wt % of Si, includes a method having a step of repressurizing (secondary pressurizing) molten metal quickly after injection of the molten metal into a mold is completed.

In the piston manufacturing method of the present invention, the secondary pressurizing is carried out so that the contact pressure between the mold and the molten metal is high and the cooling rate of the molten metal is increased. As a result, the crystallization of the primary crystal Si is suppressed on the surface layer of the molten metal, and the fatigue strength on the entire portion of the piston is improved. In the portion at which the wear resistance is desired to be improved, the surface layer is removed by a mechanical method such as machining and cutting, or a chemical method such as etching, so that the primary crystal Si may be exposed at the surface.

When the secondary pressurizing of the molten metal is carried out after the solidification of the molten metal progresses, its effect is small. According to the examination of the present invention, it is desirable that the molten metal be subject to the secondary pressurizing within 1.5 seconds after the injection of the molten metal into the mold is completed. In the case in which the secondary pressurizing is carried out, instead of eliminating the surface layer, a heating unit is provided to a portion of the mold on which the primary Si is desired to crystallize, the mold is composed of a heat-insulating material or a heat-insulating mold release agent is applied to the mold so that the cooling rate can be slowed.

Needless to say, the piston of the present invention can also be manufactured by methods other than the manufacturing method of removing the surface layer after the second pressurizing so as to expose the primary crystal Si. For example, when a temperature control unit is provided to the mold, the cooling rate is increased on a specified portion, that is, at least on one of the combustion chamber surface, the pin boss rib which connects the pin boss and the crown, the outer peripheral surface of the lower portion of the pin boss, and the skirt rib which connects the pin boss and the skirt. The crystallization of the primary crystal Si on the surface layer including the surface can be suppressed. Furthermore, the temperature control unit of the mold includes a method of distributing a cooling medium into the mold or spraying an air-type or liquid-type cooling medium of air to the mold.

According to the present invention, the first eutectic structure, in which the primary crystal does not crystallize, and the second eutectic structure, in which the primary crystal Si crystallizes, are used separately depending on the portion. For this reason, both the fatigue strength and the wear resistance can be provided without increasing the production cost.

DESCRIPTION OF THE PREFERRED EMBODIMENT

The preferred embodiment of the present invention is explained below.

Figure 1A:
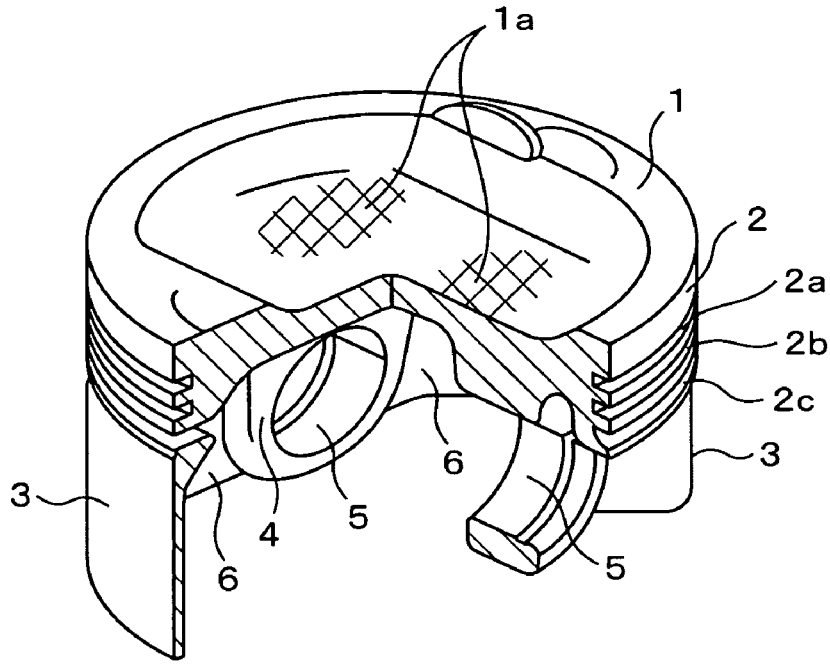
FIGS. 1A and 1B are partially fragmented sectional views illustrating a piston according to an embodiment of the present invention.
Figure 1B:
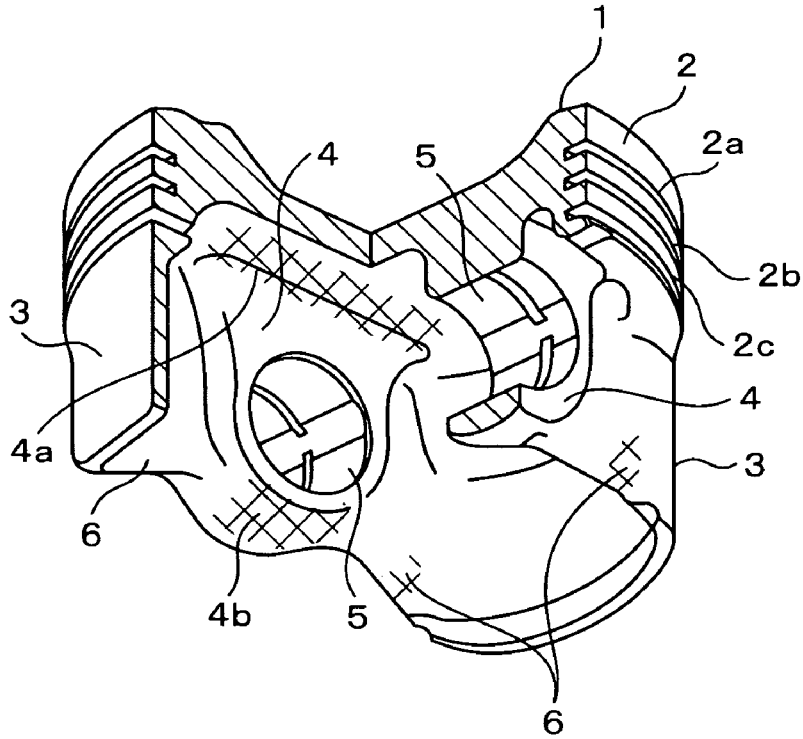

FIG. 1A is a partially fragmented sectional view obtained by viewing a piston of the embodiment obliquely from above. FIG. 1B is a partially fragmented sectional view obtained by viewing the piston obliquely from below. In the drawing, reference numeral 1 designates a piston crown. A top face of the piston crown 1 is recessed, and the top face and a cylinder, not shown, compose a combustion chamber surface 1*a* forming a combustion chamber. A top ring groove 2*a*, a second ring groove 2*b*, and an oil ring groove 2*c* are formed, in this order, from above on a cylindrical surface 2 which extends from an outer peripheral portion of the piston crown 1 in a vertical direction. A top ring, a second ring, and an oil seal are fitted into them, respectively.

An opposed piston skirt portion 3 is formed on a lower edge of the cylindrical surface 2. An outer peripheral surface of the piston skirt portion 3 is formed into a cylindrical surface whose diameter is slightly smaller than the cylindrical surface. A pin boss 4 which is thicker than the other portion is formed on centers of side edges of the piston skirt portion 3, and a pin holing of a piston pin 5 is formed on the pin boss 4. The side edges of the pin bosses 4 and the piston skirt portion 3 are connected by a plate-shaped skirt rib 6.

At the time of executing the internal combustion engine, a large load is applied to the combustion chamber surface 1*a* and the skirt rib 6. Furthermore, a large load is applied to a pin boss rib 4*a* which connects the pin boss 4 and the crown 1 and a lower portion 4*b* of the pin boss 4. Portions shown by slanted lines in FIGS. 1A and 1B are portions on which a particularly large load is applied. In the embodiment, therefore, at least one of the portions is a casting surface, and a surface layer including the casting surface is a first eutectic structure in which primary crystal Si does not crystallize. As a result, fatigue strength of these portions is improved. The thickness of the first eutectic structure is 5 to 200 μm. The casting surface is polished by barrel finishing or the like to an extent such that the first eutectic structure is not lost, and thus notching sensitivity on the surface is deteriorated and the fatigue strength is further improved.

The top ring groove 2*a* slidingly contacts with the top ring tightly, and the pin holing of a piston pin 5 slidingly contacts with a piston pin tightly. The top ring groove 2*a* and the pin holing of a piston pin 5 are finished surfaces where a surface layer is removed by machine work or the like, and the layer including the finished surface is a second eutectic structure where the primary crystal Si crystallizes. When the hard primary crystal Si is exposed from the surface, the wear resistance is improved.

EXAMPLE

1. Manufacturing of the Piston

Figure 2A:
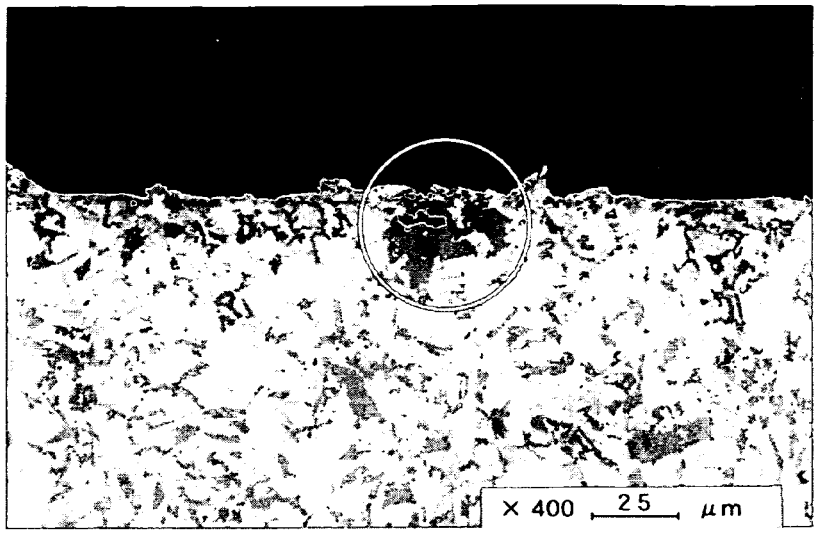
FIGS. 2A to 2C are photomicrographs showing primary crystal Si of the piston in an example of the present invention.
Figure 2B:
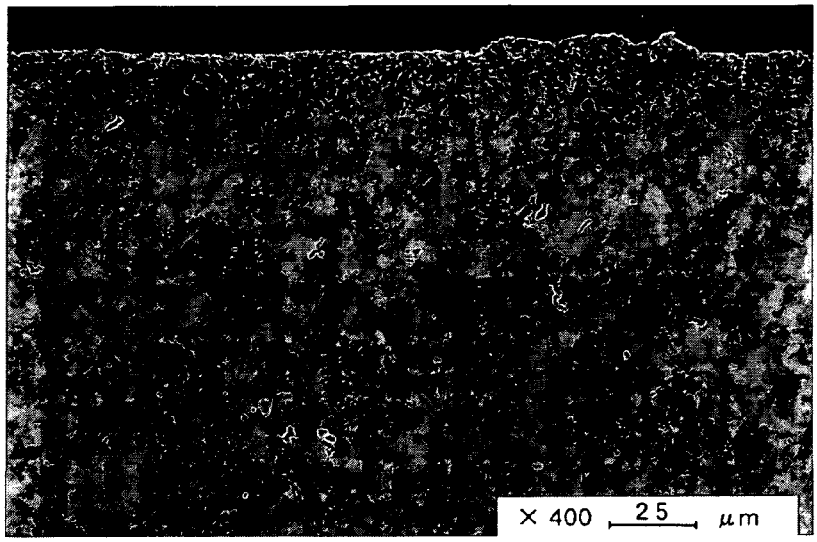
Figure 2C:
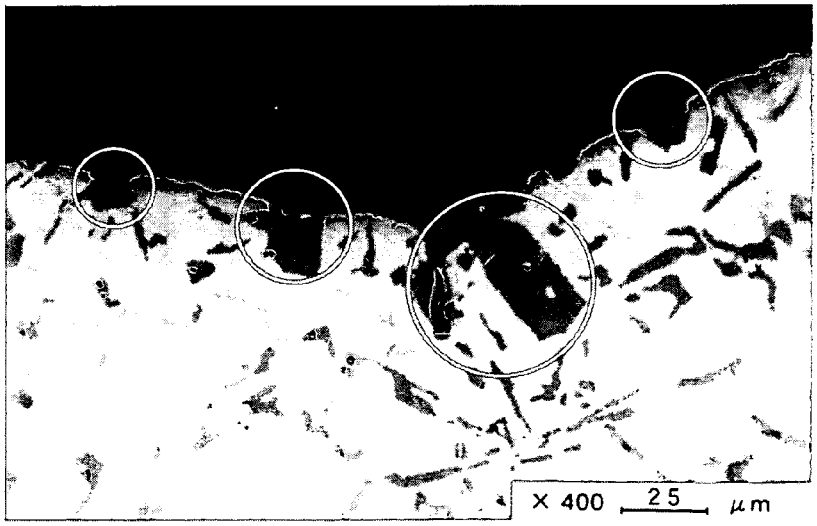

A piston was cast using a hypereutectic Al—Si aluminum alloy having the composition shown in Table 1 according to a die casting method. In the die casting, a die casting machine able to apply 250 tons was used, the temperature of molten metal was 720° C., and the temperature of the mold was 250° C. The hypereutectic Al—Si aluminum alloy was injected into the mold having a piston-shaped cavity at an injection speed of 2.5 m/s. The cast piston was subject to the machine work so as to be a final product, and microstructures in respective portions of the casting surface (combustion chamber surface) and the machine-worked surface (top ring groove) were observed. For comparison, a piston was cast by using a hypereutectic Al—Si aluminum alloy having a composition shown in Table 1 according to a gravity casting method, and a microstructure on the casting surface (combustion chamber surface) was observed. The results are shown in FIGS. 2A to 2C.

TABLE 1

| | Manufacturing | Material Composition (wt %, P by ppm) | | | | | |
|---|---|---|---|---|---|---|---|
| | Method | Si | Cu | Ni | Mg | Fe | P |
| Example | Die Casting | 12.1 | 4.0 | 5.1 | 0.8 | 0.4 | 80 |
| Comparative Example | Gravity Casting | 12.6 | 4.9 | 1.0 | 1.0 | 0.2 | 57 |

2. Examination of Primary Crystal Si

FIG. 2A is a sectional view illustrating a surface of the top ring groove which is subject to the machine work of the piston in the example, FIG. 2B is a sectional view showing the casting surface of the combustion chamber surface, and FIG. 2C is a sectional view illustrating the casting surface (combustion chamber surface) in the piston of the comparative example. As shown in FIG. 2A, the primary crystal Si crystallizes on the surface of the top ring groove, and thus it was found that the wear resistance was obtained. As shown in FIG. 2B, the primary crystal Si, which causes the fatigue breakdown, does not crystallize on the casting surface, and thus it was found that the fatigue strength was improved. In contrast, in the comparative example, as shown in FIG. 2C, the primary crystal Si which causes the fatigue breakdown crystallizes on the casting surface, and thus it was found that the fatigue strength was insufficient.

It was confirmed that when the Al—Si aluminum alloy is cast by the die casting, the casting surface at which the primary crystal Si does not crystallize on its surface layer can be obtained. In the piston of the example shown in FIGS. 2A to 2C, the high fatigue strength is provided because the primary crystal Si does not crystallize on the combustion chamber surface, the skirt rib, the pin boss rib, and the outer peripheral surface on the lower portion of the pin boss 4 to which strong stress is applied, and the high wear resistance is provided because the primary crystal Si crystallizes on the top ring groove and the pin holing of a piston pin.

3. Property Tests

The fatigue strength and the wear resistance were tested in the case in which the primary crystal Si crystallizes on the surface of the Al—Si aluminum alloy and in the case in which the primary crystal Si does not crystallize. In the test of the fatigue strength, both ends of a round-bar type test piece with diameter of 10 mm were held by a fatigue tester (10 kN servo pulsar FT-1 made by Saginomiya Seisakusho, Inc.) with an interval of 20 mm, and a tensile stress and a compression stress were repeatedly applied to the test piece heated to 250° C. with 30 Hz. The fatigue strength at $10^8$ cycles was measured. Furthermore, in the wear resistance test, after a disc-shaped test piece with diameter of 80 mm and thickness of 10 mm was preheated at 250° C. for 100 hours, the test piece was set in a wear tester (Tribolic IV made by Riken Corporation). The test piece was heated to 250° C. by a heater provided in the wear tester, and while a ring-shaped pressing piece was being pressed against the test piece at a pressure of 148 N/cm$^2$ with a frequency of 10 Hz intermittently, the test piece was rotated at 9.8 mm/sec. The sectional area of a groove of the test piece formed by friction with the pressing piece was measured. The measured results are shown in Table 2.

TABLE 2

| Added Amount of Si (wt %) | Presence/absence of primary crystal Si | Fatigue strength at 250° C. (MPa) | Depth of wear at 250° C. ($10^{-4}$ cm$^2$) |
|---|---|---|---|
| 11 | present | 44 | 17.4 |
| 11 | absent | 51 | 24.6 |
| 13 | present | 50 | 4.1 |
| 13 | absent | 71 | 7.4 |
| 17 | present | 54 | 2.2 |
| 17 | absent | 78 | 4.3 |

As shown in Table 2, the alloy in which the primary crystal Si crystallizes on the surface has satisfactory wear resistance, but the fatigue strength is low. In contrast, the alloy in which the primary crystal Si does not crystallize on the surface has satisfactory fatigue strength, but the wear resistance is low.

4. Secondary Pressurizing Test

Figure 3A:
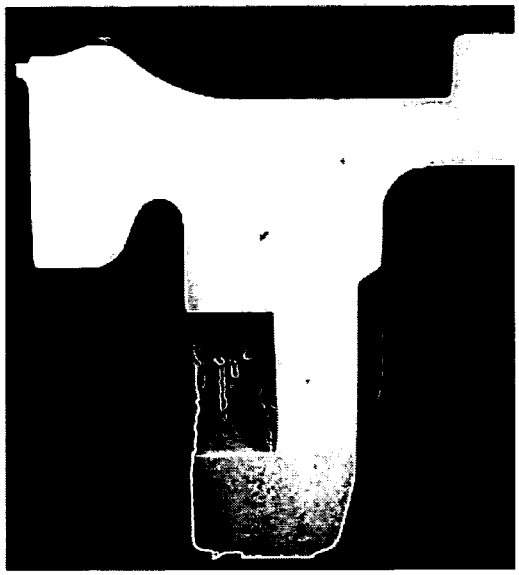
FIGS. 3A to 3C are photographs showing a casting blow hole of the piston in the example of the present invention.
Figure 3B:
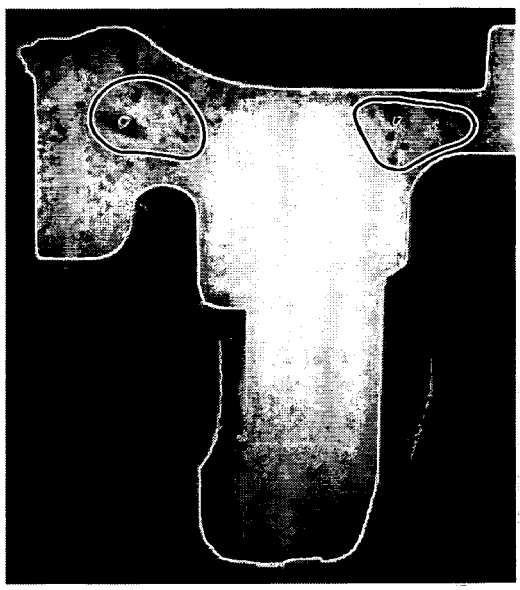
Figure 3C:
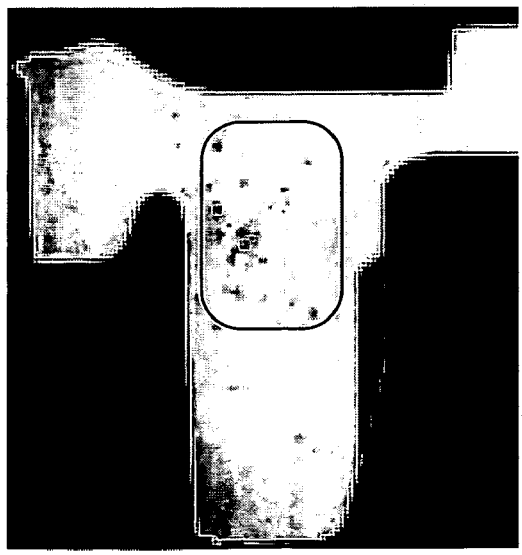

A piston was cast using the alloy in the example shown in Table 1 according to the die casting method, and after the injection was completed, secondary pressurizing was carried out at various timings. The pressure of the secondary pressurizing was the same as the injection pressure. FIGS. 3A to 3C illustrate states in which a color check was made on the cross section of the cast piston. FIG. 3A shows an example in which the secondary pressurizing was carried out 1.5 seconds after the completion of the injection, FIG. 3B shows an example in which the secondary pressurizing was carried out 3.5 seconds after the completion of the injection, and FIG. 3C shows an example in which the secondary pressurizing was not carried out. Since the porosity of the cast piston was checked, the results are shown in FIG. 4.

In the case in which the secondary pressurizing was carried out, when the timing was late, solidification progressed quickly on a portion of the piston having a relatively small thickness. The internal pressure of the piston is reduced due to the solidification shrinkage. As shown in FIG. 3A, when the timing of the secondary pressurizing was 1.5 seconds after the completion of the injection, a casting blow hole was slightly formed, but as shown in FIG. 3B, in the case in which the timing of the secondary pressurizing was 3.5 seconds after the completion of the injection, the casting blow holes were generated in a wide range due to the lowering of the internal pressure of the piston. As shown in FIG. 3C, in the case in which the secondary pressurizing was not carried out, the casting blow holes were generated in a wider range. It is believed that the contact pressure between the mold and the portion at which the casting blow holes were generated was reduced, and thus the effect produced by quenching of the casting surface was eliminated.

Figure 4:
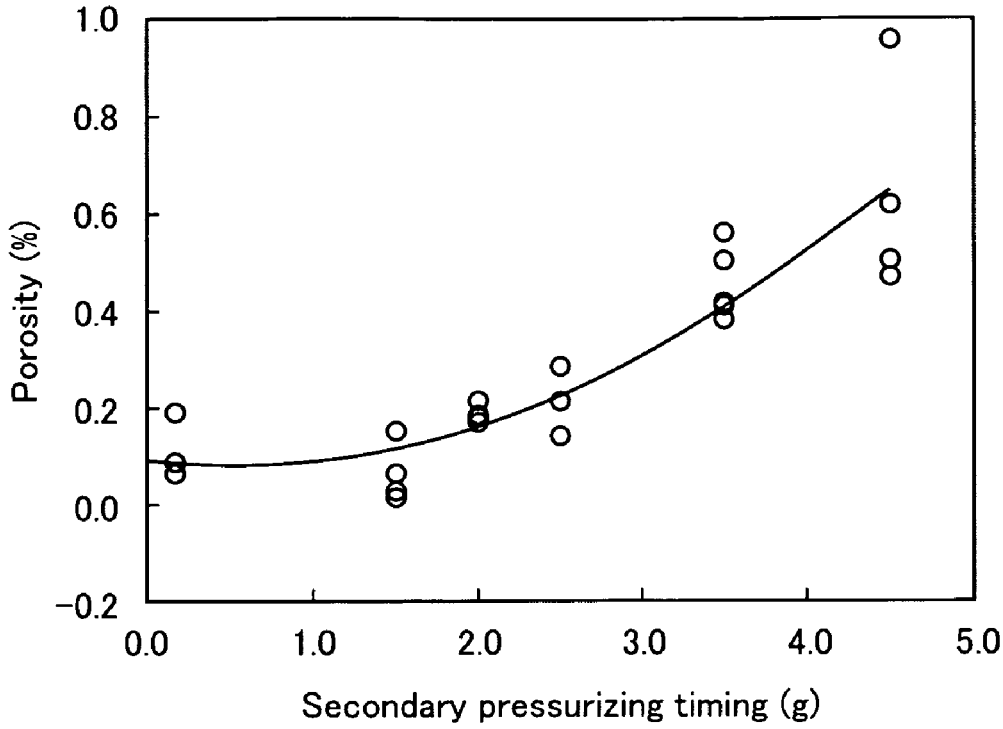
FIG. 4 is a graph illustrating a relationship between secondary pressurization timing and porosity in the example of the present invention.

As shown in FIG. 4, when the timing of the secondary pressurizing was within 1.5 seconds after the completion of the injection, the porosity representing the volume of the casting blow hole was small, but when the timing exceeded 1.5 seconds, the porosity increased abruptly. As a result, the timing of the secondary pressurizing was preferably within 1.5 seconds after the completion of the injection.

Since the piston of the present invention has both fatigue strength and wear resistance without increasing the production cost, it can be effectively used for internal combustion engine which requires durability and reduced cost.

What is claimed is:

1. A piston for internal combustion engine obtained by die-casting a hypereutectic Al—Si alloy comprising 11 to 18 wt % of Si, the piston comprising:

a piston crown whose top face is a combustion chamber surface;

a piston skirt portion;

a pin holing of a piston pin;

a pin boss which the pin holing of a piston pin pierces; and a top ring groove formed on an outer peripheral surface, wherein at least one of the combustion chamber surface, a pin boss rib which connects the pin boss and the crown, an outer peripheral surface of a lower portion of the pin boss, and a skirt rib which connects the pin boss and the piston skirt portion is a casting surface, a surface layer including the casting surface is composed of a first eutectic structure in which the primary crystal Si does not crystallize, at least one of the top ring groove and the pin holing of a piston pin is a finished surface which is obtained by eliminating the surface layer, and a layer including the finished surface is composed of a second eutectic structure in which the primary crystal Si crystallizes.

2. The piston for internal combustion engine according to claim 1, wherein the piston further comprises at least one of 1.0 to 6.0 wt % of Cu, 1.0 to 6.0 wt % of Ni, 0.5 to 2.0 wt % of Mg, 0.1 to 2.0 wt % of Fe and 30 to 200 ppm of P, and the remainder is composed of Al and unavoidable impurities.

3. The piston for internal combustion engine according to claim 1, wherein the piston further comprises 0.01 to 0.3 wt % of at least one of Mn, Cr, Ti, V and Zr in total.

4. The piston for internal combustion engine according to claim 2, wherein the piston further comprises 0.01 to 0.3 wt % of at least one of Mn, Cr, Ti, V and Zr in total.

* * * * *